US006003001A

United States Patent [19]

Maeda

[11] Patent Number: 6,003,001

[45] Date of Patent: Dec. 14, 1999

[54] SPEECH ENCODING METHOD AND APPARATUS

[75] Inventor: Yuji Maeda, Tokyo, Japan

[73] Assignee: Sony Corporation, Tokyo, Japan

[21] Appl. No.: 08/882,156

[22] Filed: Jun. 25, 1997

[30] Foreign Application Priority Data

Jul. 9, 1996 [JP] Japan ..... 8-179178

[51] Int. Cl.[6] ..... G10L 3/02; G10L 9/00

[52] U.S. Cl. ..... 704/223; 704/219; 704/220

[58] Field of Search ..... 704/225, 224, 704/223, 219, 220

[56] References Cited

U.S. PATENT DOCUMENTS 5,732,389 3/1998 Kroon ..... 704/223

*Primary Examiner*—David R. Hudspeth
*Assistant Examiner*—Robert Louis Sax
*Attorney, Agent, or Firm*—Jay H. Maioli

[57] ABSTRACT

In encoding in which an adaptive codebook such as PSI-CELP or a fixed codebook is used on switching selection, waveform distortion caused by selection of the fixed codebook in case input speech frequency components are changed significantly is diminished. An output of an adaptive codebook 21 or an output of a fixed codebook 22 is selected by a changeover selection switch 26 and summed to an output of noise codebooks 23, 24 so as to be sent to a linear prediction synthesis filter 16. A switching control circuit 19 for controlling the switching of a changeover control switch 26 operates in response to a prediction gain which is a ratio of the linear prediction residual energy to the initial signal energy from a linear prediction analysis circuit 14 so that, if the prediction gain is smaller than a pre-set threshold value, the switching control circuit 19 judges the input signal to be voiced and controls the changeover control switch 26 for compulsorily selecting the output of the adaptive codebook 21.

6 Claims, 4 Drawing Sheets

SPEECH ENCODING METHOD AND APPARATUS

BACKGROUND OF THE INVENTION

1. Field of the Invention

This invention relates to a speech encoding method and apparatus for encoding speech signals by digital signal processing with high efficiency.

2. Description of the Related Art

Recently, a speech encoding method with a low bit rate of the order of 4.8 to 9.6 kbps, for example, applicable to a car telephone, a portable telephone or to television telephone, has been developed. A code excited linear prediction (CELP) encoding method, such as vector sum excited linear prediction (VSELP) encoding method, has been proposed as the speech encoding method . There is also proposed, a so-called half-rate speech encoding method, having a halved bit rate, such as a bit rate on the order of 3.45 kbps, CELP encoding with pitch synchronization processing, that is a so-called pitch synchronous innovation- CELP (PSI-CELP), has been proposed.

This PSI-CELP encoding method is of a CELP type encoding system and includes, a codebook for excited code vector as an excitation source, an adaptive codebook for long-term prediction, a fixed codebook and a noise codebook. The PSI-CELP encoding method is characterized in that the noise codebook is rendered periodic in association with the pitch period lag of the adaptive code vector. The pitch synchronization of the noise codebook is realized by taking out the speech corresponding to a pitch period, as the basic speech period, from the leading end of the noise codebook, and by modifying the speech thus taken out into a repetitive form for improving the quality of the voiced portion. Also, with the PSI-CELP, it is aimed to improve the expressive character of the non-periodic speech by switching between the adaptive codebook and the fixed codebook.

With the above-described PSI-CELP, the voiced speech and the unvoiced speech are effectively processed for speech synthesis by selectively switching between the fixed codebook and the adaptive codebook as a long-term predictive filter responsive to input signals. However, if frequency components of the voiced speech are significantly changed between forward and backward sub-frames, the fixed codebook is predominantly selected, thus impairing continuity of the decoded speech and possibly producing waveform distortion.

In selecting the code vector of the adaptive codebook and the fixed codebook, candidates exhibiting the strongest correlation with the input signals are selected. For example, if the input speech is changed from the speech containing many high-frequency components to the speech where the specified low frequency range is predominant, the state of the adaptive codebook of the long-term prediction filter cannot follow up with such changes, as a result of which the fixed codebook exhibiting strong correlation is predominantly selected. However, on decoding, speech continuity is impaired significantly, such that waveform distortion is produced in the worse case.

SUMMARY OF THE INVENTION

It is therefore an object of the present invention to provide a speech encoding method and apparatus whereby it becomes possible to reduce waveform distortion produced by selecting the fixed codebook despite the fact that the encoded speech portion is the voiced speech.

According to the present invention, at least an adaptive codebook and a fixed codebook are provided as an excitation source for synthesizing the speech signals. When the adaptive codebook or the fixed codebook is selected and an output is supplied to a synthesis filter, the input signal is judged as to whether it is voiced based on its signal energy. If the input signal is judged to be voiced, the adaptive codebook is selected compulsorily.

In giving the above judgment, the input signal is judged to be voiced if the prediction gain eL/eO is smaller than a pre-set threshold TH (eL/eO<TH), wherein eO is the initial signal energy and eL is the linear prediction residual energy. In this case, the adaptive codebook is selected compulsorily.

In giving the above judgment, the input signal may also judged to be voiced if the adaptive codebook is selected in the directly previous domain of linear predictive analysis and the signal energy $P_{SUB}$ of the current domain for linear predictive analysis is larger than a pre-set threshold value $P_{TH}$ ($P_{SUB}>P_{TH}$). If the input signal is judged to be voiced, the adaptive codebook is selected compulsorily.

According to the present invention, the input signal is judged to be voiced or unvoiced based on its signal energy and, if the input signal is judged to be voiced, the adaptive codebook is selected compulsorily. Thus, even in cases wherein the fixed codebook is selected with the conventional system due to significant changes in the frequency components of the input speech, which in effect is voiced, the adaptive codebook is selected compulsorily, so that it becomes possible to alleviate waveform distortion possibly produced in the decoded speech.

If the above judgment is given on the condition whether the prediction gain eL/eO, where eO is the initial signal energy and eL is the linear prediction residual energy, is smaller than the pre-set threshold value TH (eL/eO<TH), the voiced/unvoiced decision can be given reliably. If the above judgment is given on the condition whether the adaptive codebook is selected in the directly previous domain of linear predictive analysis and the signal energy $P_{SUB}$ of the current domain for linear predictive analysis is larger than a pre-set threshold value $P_{TH}$ ($P_{SUB}>P_{TH}$), the voiced/unvoiced decision can in like manner be given reliably.

DESCRIPTION OF THE PREFERRED EMBODIMENTS

Figure 1:
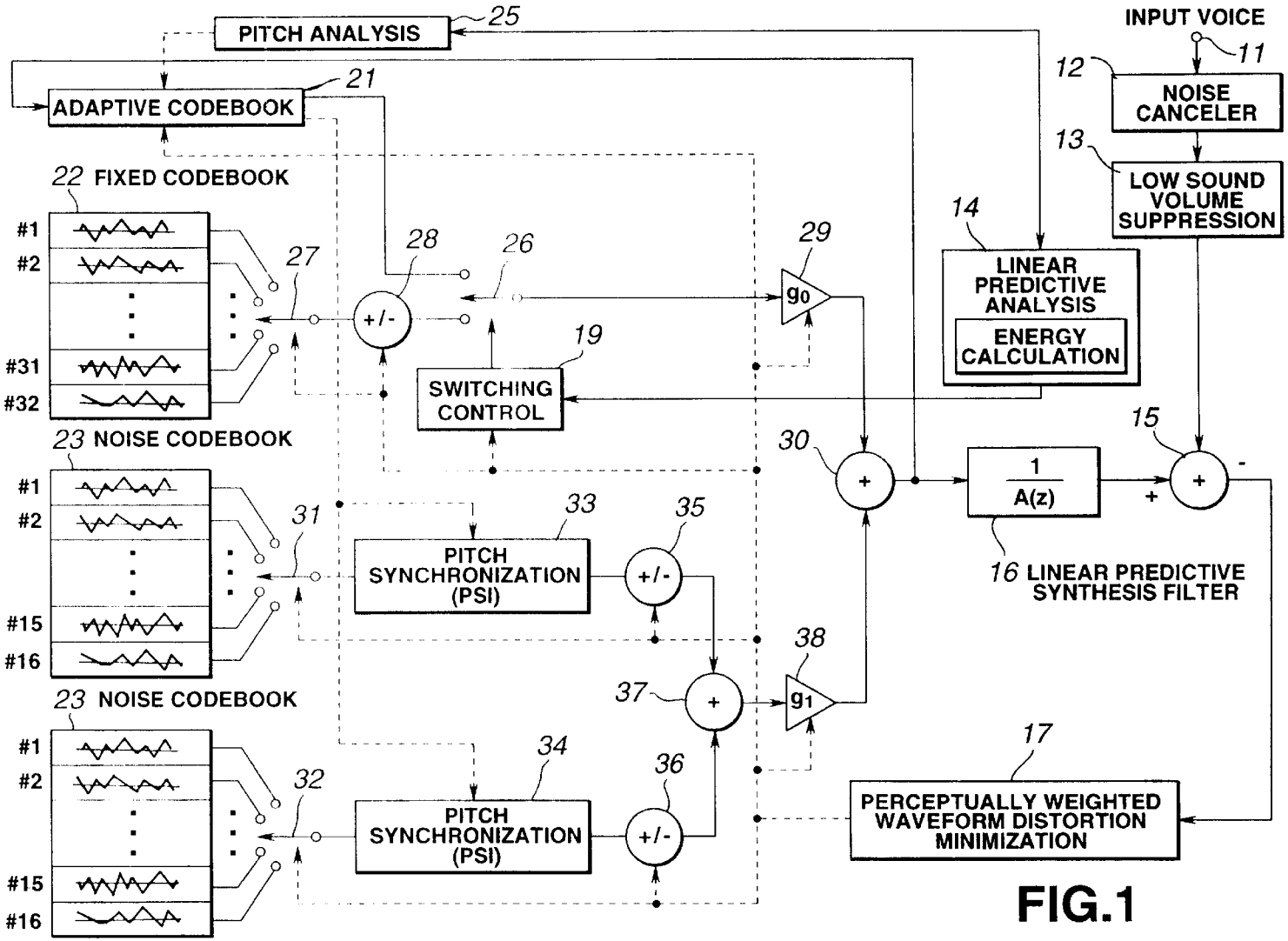
FIG. 1 is a schematic block diagram showing the structure of an encoding device for illustrating an embodiment of the present invention.

Referring to the drawings, preferred embodiments of the present invention will be explained in detail.

FIG. 1, illustrates an embodiment of the present invention. In the embodiment, shown in FIG. 1, the present invention is applied to the above-mentioned so-called pitch synchronous innovation-code excited linear prediction (PSI-CELP) encoding method.

In FIG. 1, speech signals (input speech) supplied to an input terminal 11 is sent to a noise canceler 12 for removing noise components. The resulting signal is then routed to a low sound volume suppressing circuit 13 for suppressing low-level components. An output of the low sound volume suppressing circuit 13 is sent to a linear prediction (LPC) analysis circuit 14 and to a subtractor 15. Specifically, with the sampling frequency of 8 kHz, the encoding frame of 40 ms (320 samples) and the number of sub-frames equal to 4, with the sub-frame duration being 120 ms (80 samples), the domain of analysis is taken so as to be 20 ms (160 samples), with the center of each sub-frame being the center of analysis. In linear prediction analysis, the α-parameter of LPC is calculated and quantized in linear spectral pair (LSP) area so as to be used as a short-term prediction coefficient used in a linear prediction synthesis filter 16. The linear prediction synthesis filter 16 synthesizes signals from an excitation source having a codebook as later explained, by linear prediction (LPC) synthesis processing, and routes the resulting signal to the subtractor 15. The subtractor takes out an error between a synthesized output of the synthesis filter 16 and the input speech from the low sound volume suppressing circuit to send the resulting error to a perceptually weighted waveform distortion minimizing circuit 17, which then controls the excitation source for minimizing the error from the subtractor 15, that is for minimizing the waveform distortion.

An adaptive codebook 21, as a long-term prediction filter, a fixed codebook 22 and two noise codebooks 23, 24 are used as an excitation source. The adaptive codebook 21 receives the signal sent from the excitation source to the synthesis filter 16 as an input and delays the input signal by an amount corresponding to the pitch period detected from the input speech (pitch lag) to output the resulting delayed signal. The pitch lag is detected by analyzing the speech signal from the low sound volume suppressing circuit 13 by a pitch analysis circuit 25. The fixed codebook 22 is provided for complementing the adaptive codebook 21. The unvoiced speech portion is improved in expressive force by employing the fixed codebook 22. The excited code vector, outputted by the adaptive codebook 21, or that outputted by the fixed codebook 22, is selected by a changeover selecting switch 26. The excited code vector in the fixed codebook 22 is selected by a changeover selecting switch 27 and has its polarity set by a polarity setting circuit 28, so as to be sent to the changeover selecting switch 26. An output of the changeover selecting switch 26 is multiplied by a coefficient multiplier 29 with a coefficient go before being fed to an adder 30. The excited code vectors of the noise codebooks 23, 24 are selected by changeover selection switches 31, 32 and routed to pitch synchronization circuits 33, 34, respectively. The pitch synchronization circuits 33, 34 take out only the pitch lag obtained by the adaptive codebook 21 from the input noise code vectors to repeat the pitch lags by way of pitch synchronous innovation (PSI) innovation processing, and route the resulting modified signal to an adder 37 via polarity setting circuits 35, 36, respectively. An addition output of the adder 37 is sent to a coefficient multiplier 38 where it is multiplied by a coefficient gl before being supplied to the adder 30. An output of the adder 30 is sent to the linear prediction synthesis filter 15. The perceptually weighted waveform distortion minimizing circuit 17 controls the pitch lag of the adaptive codebook 21, selecting states of the changeover selection switches 27, 31, 32, the polarities of the polarity setting circuits 28, 35, 36 and the coefficients g0, g1 of the coefficient multipliers 29, 38, for minimizing the error between the synthesis output of the linear prediction synthesis filter 15 and the speech from the low sound volume suppressing circuit 13.

Although respective parts of the device of FIG. 1 may be constructed by hardware, part or all of the device may also be implemented by software technique by a digital signal processor (DSP).

An illustrative conventional technique of selection of the pitch lag of the adaptive codebook 21 and the code vector of the fixed codebook 22 is hereinafter explained. In selecting the pitch lag of the adaptive codebook 21, six pitch lags, for example, counted from the higher pitch intensity value as found by pitch analysis by the pitch analysis circuit 25, are used, and ¼ sample precision at the maximum is used for improving pitch prediction precision. Thus, from outputs of the adaptive codebook 21 corresponding to 24 pitch lags at the maximum, two of the pitch lags are preliminarily selected which will reduce the error between a linear predictive synthesized output and the perceptually weighted input speech, or which, for example, will maximize the correlative value. Similarly, for the fixed codebook 22, two of the code vectors exhibiting high correlation between the linear predictive synthesized output of the code vector and the perceptually weighted input speech are selected preliminarily. Next, two of these four excited code vectors exhibiting maximum correlation with respect to the perceptually weighted input speech are selected. A noise codebook is selected for each code vector and its gain set, after which one of the two code vectors having a smaller error from the weighted input speech is selected.

Meanwhile, the adaptive codebook 21 or the fixed codebook 22 is selected only in correlation with the weighted input speech. For example, if an input is changed from a speech containing abundant high-frequency components to the speech having the frequency concentrated mainly in a specified frequency, there are occasions wherein the state of the adaptive codebook cannot follow up with such change in the input, as a result of which the fixed codebook having higher correlation is mainly selected. However, on decoding, the speech is impaired significantly in continuity, producing waveform distortion in the worst case.

Thus, in the embodiment of the present invention, the linear prediction residual energy, obtained during computation by the linear prediction analysis circuit 14, is used. On the other hand, if the specified low-frequency component of the current input speech is strong, the predicted gain is of a sufficiently large value. In this case, the adaptive codebook is selected compulsorily.

Referring to FIG. 1, there is provided a switch control circuit 19 for controlling the switching of the changeover election switch 26. To this switch control circuit 19 is supplied not only the information from the perceptual weighted waveform distortion minimizing circuit 17 but also the information on the linear prediction residual energy information obtained during computation in the linear prediction analysis circuit 14. Based on the above information, the switch control circuit 19 controls the changeover election switch 26. The operation at this time is explained with reference to a flowchart of FIG. 2.

Figure 2:
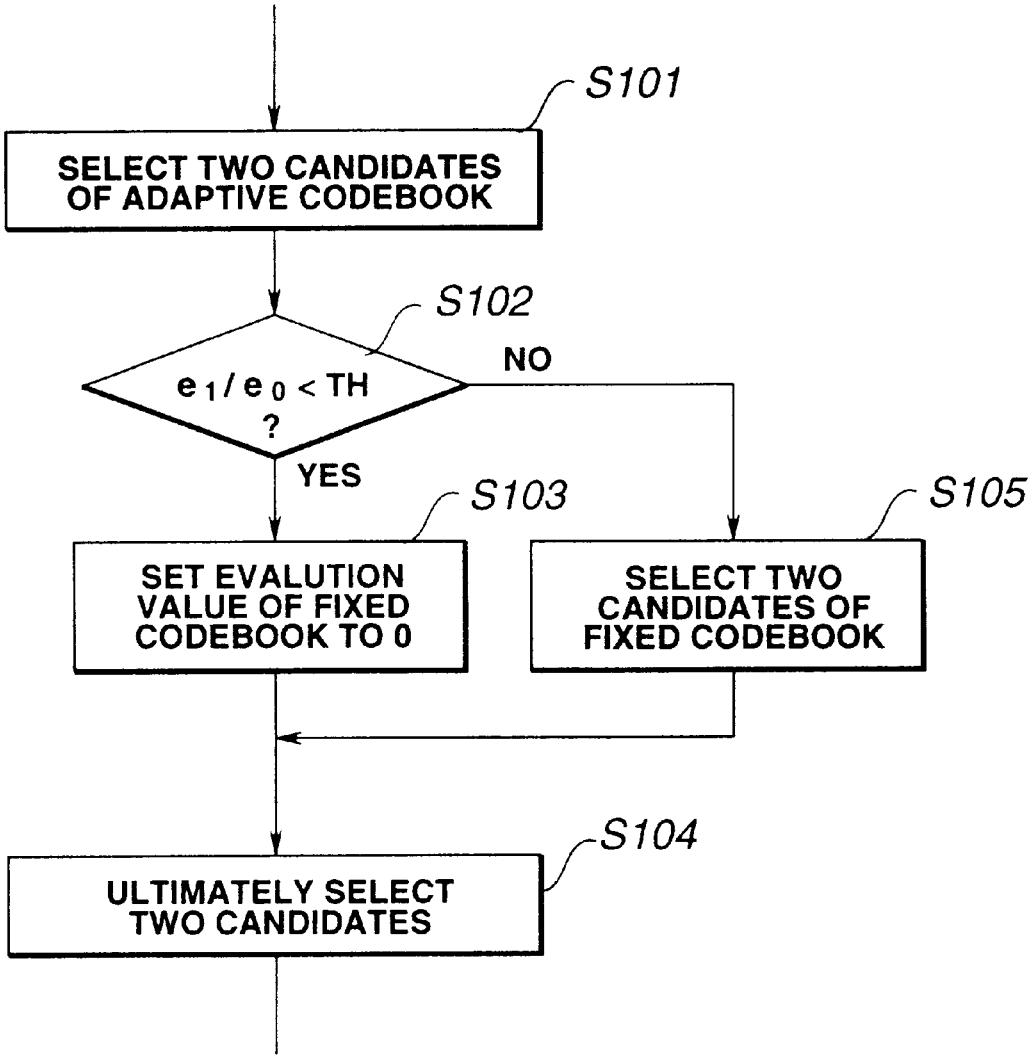
FIG. 2 is a flowchart for illustrating the operation of several portions of the embodiment shown in FIG. 1.

Referring to FIG. 2, two candidates are selected at step S101 by preliminary selection of the adaptive codebook 21. A correlation evaluation value between an output obtained on linear predictive synthesis of the codebook outputs and the perceptually weighted input speech is maintained. At the next step S102, it is checked whether or not a prediction gain eL/eO, where eO is the initial signal energy as found by the linear predictive analysis from one sub-frame to another and eL is an ultimate linear prediction residual energy, is smaller than a pre-set threshold value TH (eL/eO<TH). The signal energy eO can be found by a square sum of samples of the input speech in a range of linear prediction analysis, while the linear prediction residual value eL is found in the course of finding PARCOR coefficient (partial self-correlation coefficient) for linear predictive analysis of the input speech. The domain of linear predictive analysis is an area of 20 ms obtained on overlapping one-half sub-frames before and after a sub-frame with the center of the sub-frame (10 ms) as center. The above threshold value TH may, for example, be −24 dB or less.

If the result of check of step S102 is YES, that is if eL/eO<TH, it is judged that a sufficient prediction gain is provided and hence the input sound is the voiced. Thus, processing transfers to step S103 where the evaluation value is set to 0 without doing retrieval of the fixed codebook. Then, processing transfers to step S104. If conversely the result of check at step S102 is NO, processing transfers to step S105 where two candidates are selected by the above fixed codebook search before processing transfers to step S104. At this step S104, two candidates are ultimately selected based on the evaluation values of the four candidates. If the evaluation value of the fixed codebook is found to be 0 at step S103, the adaptive codebook is selected compulsorily.

Figure 3:
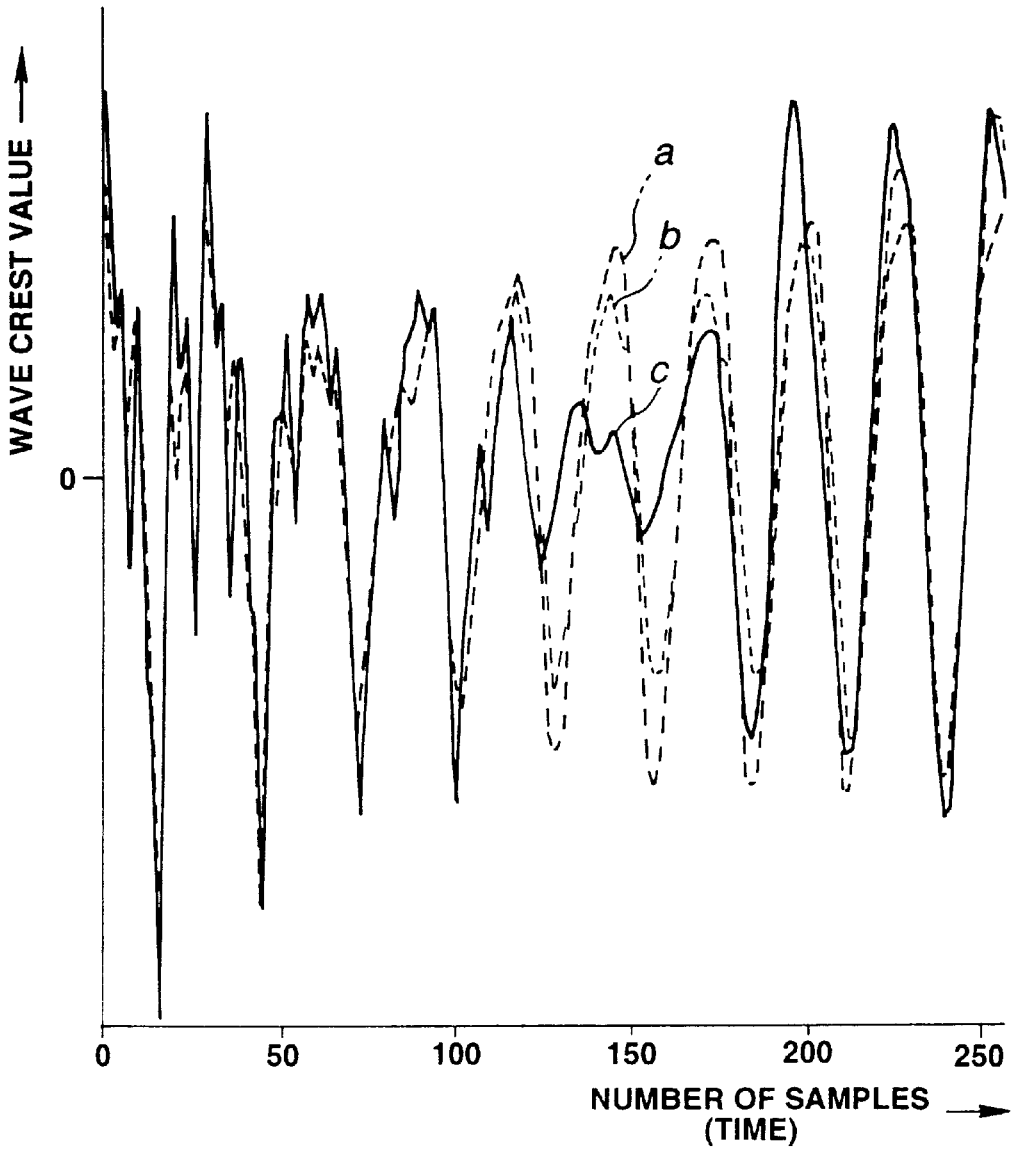
FIG. 3 illustrates how the wavelength distortion is reduced in the embodiment shown in FIG. 1.

In FIG. 3, showing the manner of alleviation of the waveform distortion on encoding and then decoding the input speech, curves a, b and c denote an original input speech signal, a decoded speech signal of the signal encoded in accordance with the present embodiment and a decoded speech signal of the signal encoded by a conventional method. It will be seen from comparison of the curves a to c that the waveform distortion, which occurred with the conventional method in case of significant change in the frequency components of the input speech, can be significantly alleviated on encoding with the method of the present embodiment such that decoded speech is close to the original input speech.

A modified embodiment of the present invention is hereinafter explained. In the present modification, if, at the time of selecting the above-mentioned adaptive and fixed codebooks, the directly previous sub-frame is an adaptive codebook, and a signal energy $P_{SUB}$ of the sub-frame is larger than a pre-set threshold $P_{TH}$, the adaptive codebook is selected compulsorily. This signal energy $P_{SUB}$ of the sub-frame is a square sum of the samples in the 10 ms domain corresponding to the sub-frame.

Figure 4:
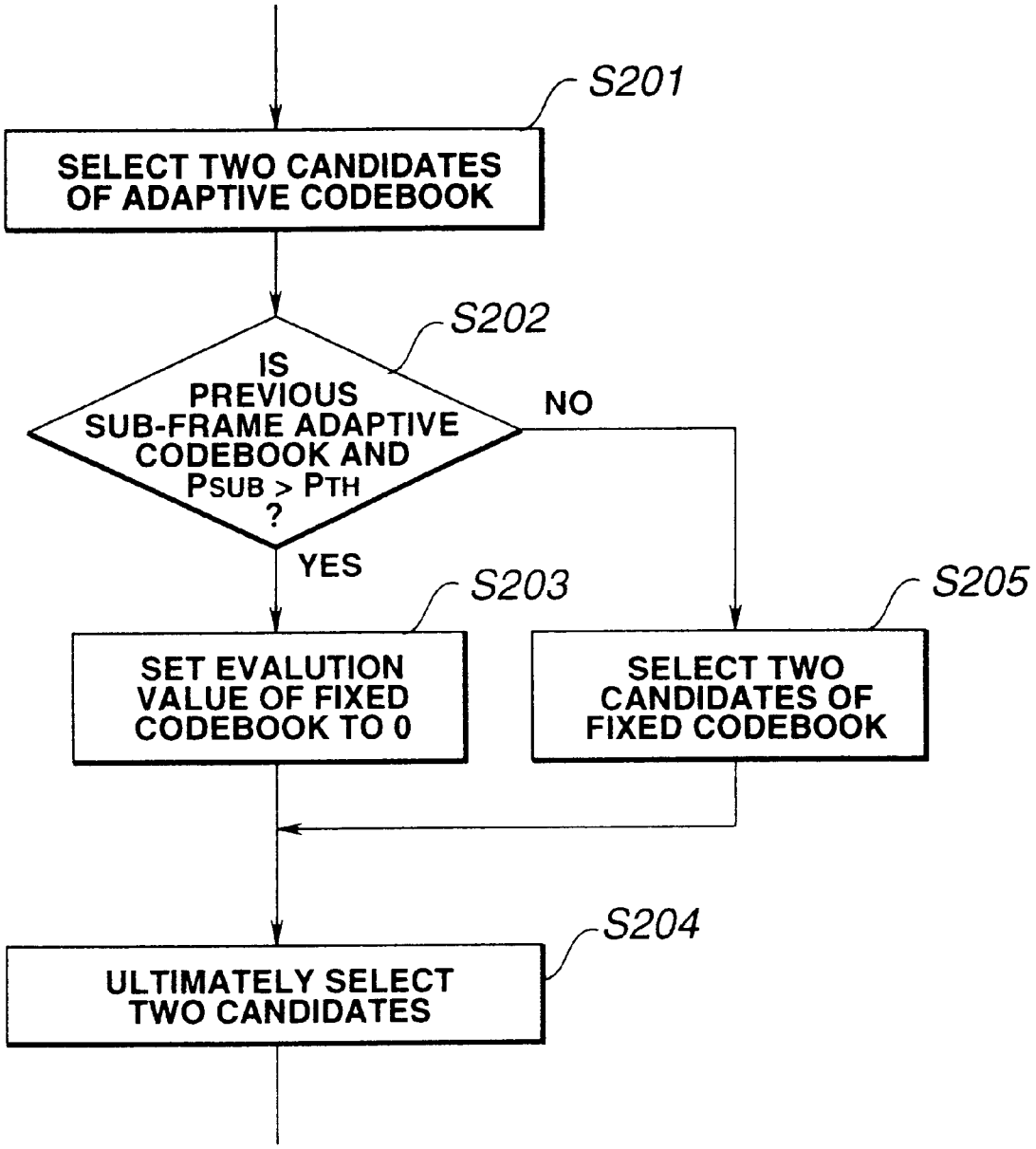
FIG. 4 is a flowchart for illustrating the operation of several portions of a modification of the present invention.

FIG. 4 shows a flowchart for illustrating the operation of essential parts of the present embodiment. At step S201 of FIG. 4, two candidates are selected by preliminary selection of the adaptive codebook 21, and an output obtained on linear predictive synthesis of the codebook outputs and the value of correlation evaluation of the perceptually weighted input speech are maintained. At the next step S202, it is checked whether or not the result of selection of the directly previous sub-frame is the adaptive codebook, and also whether or not the energy $P_{SUB}$ of the current sub-frame, such as square sum of the samples in the sub-frame, is larger than the pre-set threshold value $P_{TH}$ ($P_{SUB}>P_{TH}$) If the result of check at the step S202 is YES, that is if the previous sub-frame is the adaptive codebook and $P_{SUB}>P_{TH}$, the speech is judged to be voiced. Processing then transfers to step S203 where the evaluation value is set to 0 without retrieving the fixed codebook, before processing transfers to step S204. If, conversely, the result of check at step S202 is NO, processing transfers to step S205 where two candidates are selected by the above-mentioned usual fixed codebook search before processing transfers to step S204. At this step S204, two candidates are ultimately selected based on the evaluation values of the four candidates. If at step S203 the evaluation value of the fixed codebook at step S203 is 0, the adaptive codebook is selected compulsorily.

It is known that the unvoiced sound is low in sound volume, while the voiced sound is high in sound volume. Thus, if, in the above flowchart, the current speech level is high and the adaptive codebook is selected in the previous sub-frame, the sound can be judged to be voiced, so that the adaptive codebook is selected unconditionally.

Therefore, if, in the present embodiment, the frequency components of the input speech are varied significantly such that the fixed codebook should be selected in the conventional system despite the fact that the input speech is voiced, the input speech can be judged at step S202 to be voiced, and hence the adaptive codebook is selected compulsorily, thus alleviating speech waveform distortion otherwise produced in the decoded speech.

The present invention is not limited to the above-described embodiments. For example, the specified numerals values of the frames or sub-frames for linear predictive analysis or the sampling frequency can be changed optionally, while the condition for judgment on whether the input speech is voiced or unvoiced can be optionally set based on the signal energy. Moreover, the encoding with use of selectively switched adaptive codebook or fixed codebook is not limited to PSI-CELP. Various other modification are also possible within the scope of the invention.

What is claimed is:

1. A speech encoding method in which an input speech signal is divided on a time axis in terms of a pre-set frame comprising the steps of:

judging based on signal energy of the input speech signal of each current frame whether the input speech signal of each current frame is voiced and synthesizing the speech signal by selectively switching at least one of an adaptive codebook and a fixed codebook as a source of excitation;

control means selectively employing said adaptive codebook for the input speech signal judged to be voiced; and supplying an output of the adaptive codebook to a synthesis filter for synthesis of the input speech signal judged to be voiced.

2. The speech encoding method as claimed in claim 1, wherein when a prediction gain given as a ratio of a linear prediction error energy to the speech signal energy of the current frame is smaller than a pre-set value the input speech signal of the current frame is judged to be voiced.

3. The speech encoding method as claimed in claim 1, wherein when the adaptive codebook was selected at a previous frame and the speech signal energy at the current frame is larger than a pre-set value the input speech signal of the current frame is judged to be voiced.

4. A speech encoding apparatus in which an input speech signal is divided on a time axis in terms of a pre-set frame comprising:

at least one of an adaptive codebook and a fixed codebook as an excitation source;

a synthesis filter for synthesizing the input speech signal by selectively employing at least one of the adaptive codebook and the fixed codebook;

judgment means for determining, based on signal energy of the input speech signal of each current frame whether the input speech signal of each current frame is voiced; and switch control means for selecting the adaptive codebook for the input speech signal determined by said judgment means to be voiced and for supplying the input speech signal to said synthesis filter.

5. The speech encoding apparatus as claimed in claim 4, wherein said judgment means determines the input speech signal to be voiced when a prediction gain calculated as a ratio of a linear prediction error energy to the speech signal energy of the current frame is smaller than a pre-set value.

6. The speech encoding apparatus as claimed in claim 4, wherein said judgment means determines the input speech signal to be voiced when the adaptive codebook was selected at a previous frame and the speech signal energy at the current frame is larger than a pre-set value.

* * * * *